US008146178B2

(12) United States Patent
Maddux et al.

(10) Patent No.: US 8,146,178 B2
(45) Date of Patent: Apr. 3, 2012

(54) QUICK RELEASE FACEGUARD RETAINER

(75) Inventors: Larry E. Maddux, Salem, IL (US); Raymond J. Drake, Jr., Salem, IL (US); Louis Anthony VanHoutin, Luka, IL (US); Vincent R. Long, St. Peters, MO (US); Cortney Warmouth, Edwardsville, IL (US)

(73) Assignee: Kranos IP Corporation, Litchfield, IL (US)

( * ) Notice: Subject to any disclaimer, the term of this patent is extended or adjusted under 35 U.S.C. 154(b) by 364 days.

(21) Appl. No.: 12/634,413

(22) Filed: Dec. 9, 2009

(65) Prior Publication Data

US 2011/0131710 A1 Jun. 9, 2011

(51) Int. Cl.
*A42B 1/08* (2006.01)

(52) U.S. Cl. ..... 2/424; 2/9

(58) Field of Classification Search ..... 2/15, 6.3, 2/6.7, 324, 423, 425, 10, 9, 422, 424, 209.13, 2/209.14; 24/3.1, 1
See application file for complete search history.

(56) References Cited

U.S. PATENT DOCUMENTS

| | | | | | |
|---|---|---|---|---|---|
| 3,139,624 | A | * | 7/1964 | Humphrey | 2/9 |
| 3,167,783 | A | * | 2/1965 | Wolfe | 2/9 |
| 3,263,236 | A | * | 8/1966 | Humphrey | 2/9 |
| 3,889,296 | A | * | 6/1975 | Martin | 2/9 |
| 4,028,743 | A | * | 6/1977 | Christensen | 2/424 |
| 4,233,687 | A | * | 11/1980 | Lancellotti | 2/9 |
| 4,587,677 | A | * | 5/1986 | Clement | 2/424 |
| 4,594,737 | A | * | 6/1986 | Butash | 2/424 |
| 4,774,729 | A | * | 10/1988 | Coates et al. | 2/424 |
| 4,884,302 | A | * | 12/1989 | Foehl | 2/424 |
| 4,885,807 | A | * | 12/1989 | Snow, Jr. | 2/424 |
| 4,933,993 | A | * | 6/1990 | McClelland | 2/424 |
| 4,985,938 | A | * | 1/1991 | Snow, Jr. | 2/424 |
| 5,249,347 | A | * | 10/1993 | Martinitz | 29/460 |
| 5,412,814 | A | * | 5/1995 | Pernicka et al. | 2/424 |
| 5,483,699 | A | * | 1/1996 | Pernicka et al. | 2/9 |
| 5,502,843 | A | * | 4/1996 | Strickland | 2/424 |
| 5,732,414 | A | * | 3/1998 | Monica | 2/425 |
| 5,963,990 | A | * | 10/1999 | White | 2/424 |
| 5,978,973 | A | * | 11/1999 | Chartrand | 2/422 |
| 6,047,400 | A | * | 4/2000 | Spencer | 2/9 |
| 6,151,719 | A | * | 11/2000 | Poole | 2/425 |
| 6,301,719 | B1 | * | 10/2001 | Goodhand et al. | 2/422 |
| 2005/0278835 | A1 | * | 12/2005 | Ide et al. | 2/424 |
| 2009/0083900 | A1 | * | 4/2009 | Wallace | 2/424 |
| 2010/0122402 | A1 | * | 5/2010 | Tipp | 2/422 |
| 2011/0061152 | A1 | * | 3/2011 | Wismann | 2/424 |
| 2011/0131710 | A1 | * | 6/2011 | Maddux et al. | 2/424 |
| 2011/0271428 | A1 | * | 11/2011 | Withnall et al. | 2/422 |

* cited by examiner

*Primary Examiner* — Katherine Moran
*Assistant Examiner* — Richale Quinn
(74) *Attorney, Agent, or Firm* — Notaro, Michalos & Zaccaria P.C.

(57) ABSTRACT

A quick release faceguard retainer for use with a protective headgear and faceguard. The headgear has a face opening and an outer surface with a selected curvature. The faceguard has at least one top substantially horizontal bar. The retainer includes a base portion with a front surface and a back surface. The back surface of the base is adapted to be fixedly attached to the outer surface of the headgear above the face opening and has a curvature matching the curvature of the outer surface of the headgear above the face opening. Two complementary retention arms protrude out from the front surface of the base to form two complementary retention channels. One channel has a downward opening and the other has an upward opening and both have an inner surface which together surround the top horizontal bar of the faceguard. Also provided is a faceguard engagement space between the two retention arms having a size for receiving the top bar.

9 Claims, 4 Drawing Sheets

QUICK RELEASE FACEGUARD RETAINER

FIELD AND BACKGROUND OF THE INVENTION

The present invention relates generally to the field of sports headgear and in particular to a new and useful mechanism for attaching and removing a faceguard from various types of headgear.

When people engage in contact sports as well as other dangerous and potentially dangerous activities, often a situation arises where an athlete or participant is injured, paralyzed or even killed. For example, a conventional football helmet typically includes a face opening covered with a protective face mask that is permanently secured to the helmet. The face mask is often grasped by another player causing the head to twist relative to the player's body. Such a twisting motion can result in serious cervical injuries.

Often when a player or participant is injured, a medical professional must assess and sometimes also treat the injury at the very place the injury occurred.

When trainers and doctors are examining a player who has been injured, they often will need to ask the injured person questions. They also may need to look into the player's eyes and generally examine the persons face. Additionally, sometimes the injured person will need to drink water or in extreme cases will need oxygen to be administered. Therefore, a trainer or physician's view of and access to the injured persons face must be unobstructed. Accordingly in such situations, the person's faceguard must be removed.

Thus, there has always been a need for ways and means to attach and remove the faceguard from a player or participant's protective headgear and the prior art provides several means of doing so.

U.S. Pat. No. 4,370,759 to Zide discloses shock absorbing mounts for the face guard of a helmet having a substantially rigid shell and being connected to the shell allow substantial movements of the face guard relative to the helmet shell in response to forceful blows on the face guard. The mount protects the head of the wearer of the helmet from severe shocks and also prevents severe deformation of the helmet shell. The mount can be installed at all points of attachment of the face guard to the helmet to provide a resilient anchorage for the face guard without loss of security.

U.S. Pat. No. 4,774,729 to Coates et al. discloses an attachment configuration for the face mask of a football or ice hockey helmet comprising three snap-in attachments. The snap-in attachments are configured to resist without detachment sudden impacts and jarring regardless of direction. The attachments thereby prevent removal of the face mask from the helmet in normal play but reduce the likelihood of neck injury to the player in the event the face mask is accidentally or purposely grabbed in play. Each attachment comprises a plastic clip fastened to the helmet and formed with an elongated aperture adapted to receive the bottom of a U-shaped bar extending from the mask.

U.S. Pat. No. 4,985,938 to Snow, Jr. discloses a face mask release apparatus for a contact sports helmet which includes a face mask having a three point attachment to the left and right respective side portions of the helmet and to the forward forehead area of the helmet. The attachment includes a plurality of posts, positioned in pairs on each respective side of the helmet in the temple areas and a ball and socket connection in the forehead area. Each post includes a grooved area formed around the post defining a narrowed diameter section and a bracket carried at the ends of each side of the face mask forms a releasable connection with the posts in virtually all directions away from the helmet and along the helmet so that the user is protected from head and neck injury when force is applied to the mask in any of one of a plurality of directions.

U.S. Pat. No. 5,095,552 to Parkinson discloses a helmet face guard mount which includes a thin, elongated resilient pad having a curved configuration dimensioned for securement between an ear hole and a forward side edge of a conventional football helmet. Opposite ends of the pad are secured by threaded fasteners directly to the helmet. A resilient strap extends around a side bar portion of the face guard and is secured to a central portion of the pad, intermediate the opposite ends of the pad. The central portion of the pad and the attached strap are free to shift within the physical elastic limits of the pad upon application of force to the face guard. The fasteners which secure the pad to the helmet, may be at least partially integral with the pad. The strap which secures the face guard to the pad may also be integrally formed with the pad.

In addition, U.S. Pat. No. 6,047,400 to Spencer discloses a detachable face mask assembly for a helmet which includes upper and lower mask assemblies removably secured over the helmet face opening with a series of clips. The upper mask assembly includes a first outer component and a first inner component concentrically received therewithin. The inner component may be pivoted upwardly or laterally to provide temporary access to a user's eyes or nose. The lower mask assembly likewise includes a second inner and a second outer component with the inner component pivotable to either side to provide temporary access to a user's mouth or chin. Each of the components are readily and independently detachable from their respective clips upon a predetermined amount of force being applied thereto.

However, when examining and treating an injured player or participant it is also always very important to avoid moving their head and neck and to keep the head and neck still and straight at least until the injury is full assessed so that any potential or actual damage to the vertebra, spinal chord or head is not exacerbated or caused. Also, when treating many injuries it is important to treat the player or participant as soon as possible.

All of the above mentioned prior art references, however, fail to solve the problem addressed by the present invention because in order to remove the faceguard from headgear which uses the prior art requires relatively violent movement. Additionally, many of the prior art mechanisms include several points of attachment. When using one of the prior art approaches, it is very difficult to keep a player or participant's head and neck completely still while trying to quickly remove their faceguard. As a result, stress is placed on the head and neck which may exacerbate an existing injury or even cause the player or participant further injury.

There remains a clear need for a faceguard retainer which can firmly attach a faceguard to a helmet, which is simple in design and at the same time will allow a quick and smooth removal of a faceguard from the headgear in the event a player or participant is injured and needs to be examined and possibly treated at the location at which the injury occurred.

SUMMARY OF THE INVENTION

Accordingly, it is an object of the present invention to provide a faceguard retainer which is simple in design, roughed in construction and which facilitates fast and smooth attachment and removal of a faceguard from the headgear.

The faceguard retainer of the present invention accomplishes the above mentioned object by using a simple yet sturdy configuration. The faceguard retainer of the present invention is designed for use in connection with a protective headgear, for example a football helmet, and a faceguard, such as, for example a football helmet faceguard. The protective headgear must have a face opening and the faceguard used must have a top horizontal bar having an outer perimeter so that it can be held in place by the faceguard retainer. The faceguard should also have at least one lower portion as well as means for attaching the lower portion to the headgear or helmet.

The quick release faceguard retainer itself comprises a base portion which is fixed to the outer surface of the headgear in the center of, and above the face opening. The base portion also comprises a front surface and a back surface. The back surface and optionally the front surface of the base have a curvature which matches the outer curvature of the headgear it is being used in connection with. Also, the back surface of the base portion is fixedly attached to the outer surface of the headgear.

A faceguard retainer according to the present invention also comprises two complementary retention arms which protrude out from the front surface of the base. Each retention arm comprise a base end connected to the base portion and a free end opposite the base end. The retention arms hold and stabilize the faceguard and are configured to form two complementary retention channels each having an inner surface which receives the one or more top bar of the faceguard. The inner surface of the retention channels together, surround the outer perimeter of the one or more top horizontal bar of the faceguard. Finally, between the two complementary retention arms is provided a faceguard engagement and disengagement space.

The principal application of the quick release faceguard retainer of the present invention is for use in connection with various headgear used by people engaging in both, contact sports as well as activities in which those who participate may benefit from protecting their head and face.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
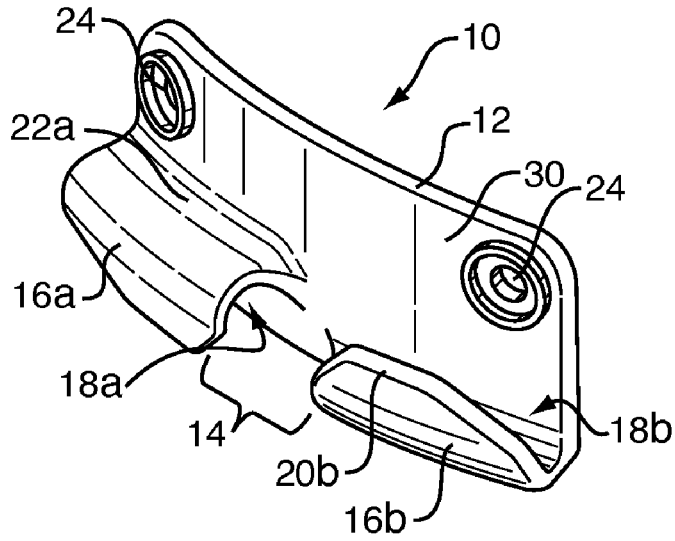
FIG. 1A is a perspective view of a quick release faceguard retainer according to an embodiment of the present invention.

Referring now to the drawings, in which like reference numerals are used to refer to the same or similar elements, FIG. 1A is a perspective view of a quick release faceguard retainer 10 according to an embodiment of the present invention.

As mentioned above, the principal application of the quick release faceguard retainer 10 of the present invention is for use in connection with various headgear 80 used by people engaging in both, contact sports as well as activities in which those who participate may benefit from protecting their head and face. A non-exhaustive list of contact sports and activities in which the participants might benefit from head and face protection are American football, hockey, lacrosse, boxing horseback riding and fencing.

Figure 2A:
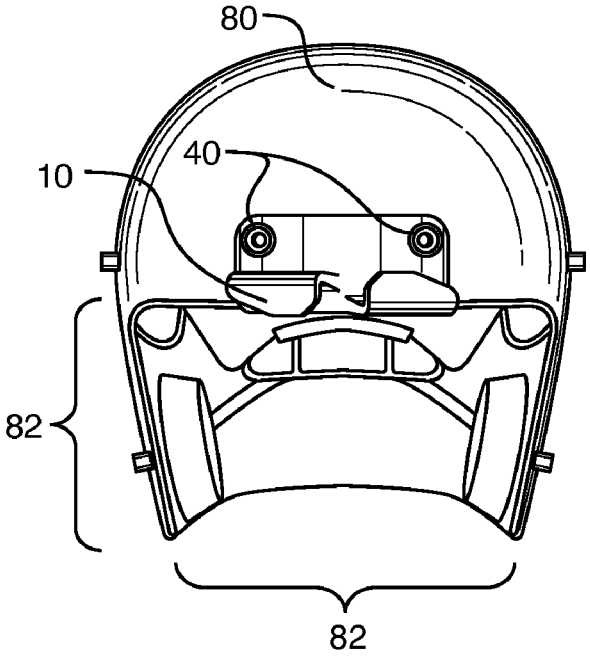
FIG. 2A is a front view of a protective headgear in the form of a football helmet and a quick release faceguard retainer according to the embodiment of the present invention shown in FIG. 1A.
Figure 2B:
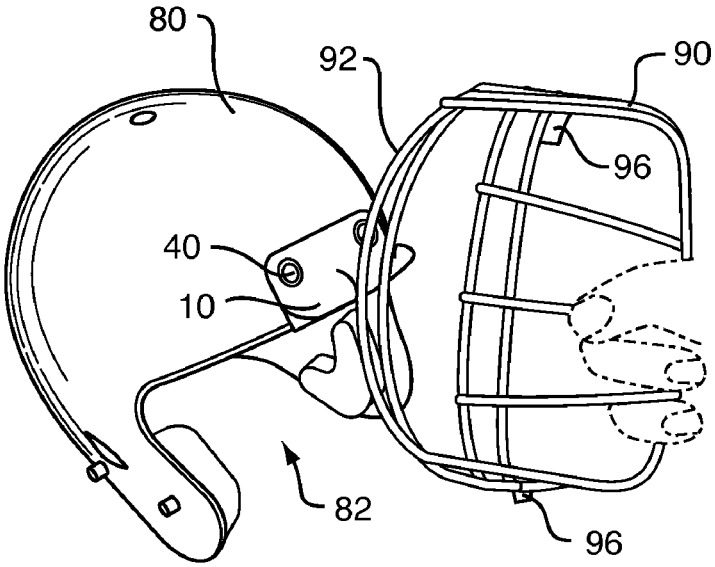
FIG. 2B is a perspective view of the protective headgear having a faceguard and the quick release faceguard retainer according to the invention and showing the bottom of the faceguard detached from the headgear.
Figure 2C:
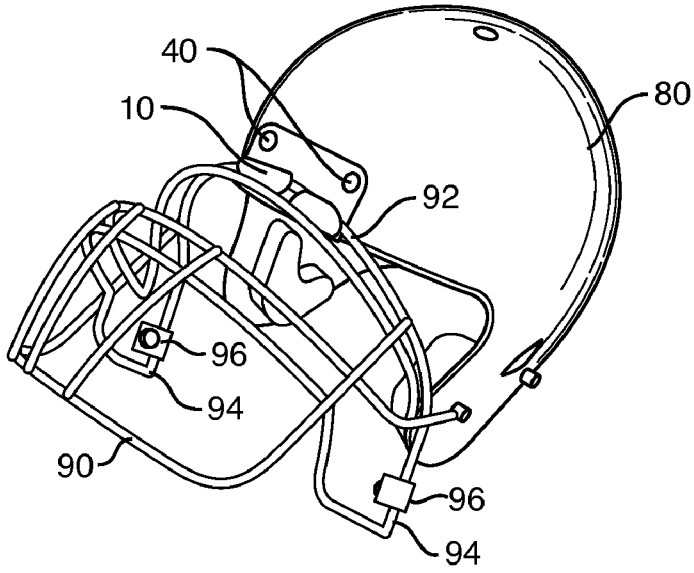
FIG. 2C is a perspective view of the protective headgear having the faceguard and the quick release faceguard retainer according to the invention showing the faceguard twisted roughly 90 degrees to engage it to the retainer.
Figure 2D:
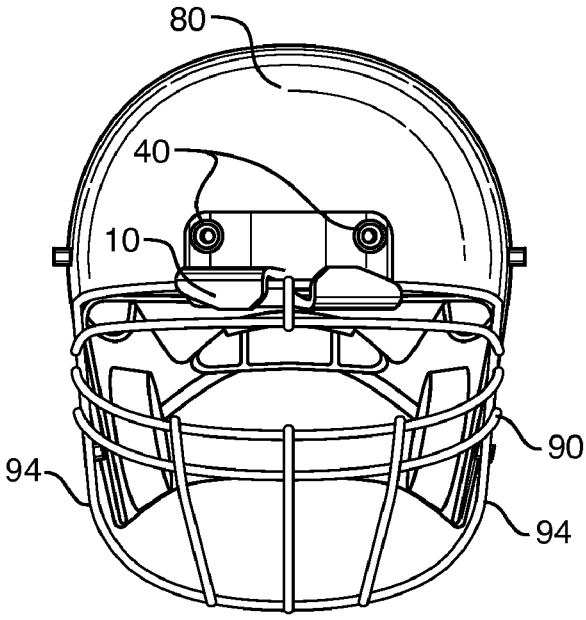
FIG. 2D is a front view of the helmet having and the quick release faceguard retainer according to the invention with the faceguard in place for play.

The quick release faceguard retainer 10 is for use with protective headgear such as a football helmet 80 in FIG. 2A, with a faceguard 90. The helmet 80 has a face opening 82 and an outer surface with a selected curvature. The faceguard 90 includes a top substantially horizontal bar 92 with an outer perimeter, at least one lower portion 94 as well as means 96 for attaching the at least one lower portion 94 to the helmet 80. Although one continuous top bar 92 is shown in FIGS. 2B, 2C and 2D, the inventive release 10 can also operate with a faceguard 90 having two top bars 92 that are separate but which can each engage the retainer 10 as will be explained later.

Furthermore, for purposes of this application the term "horizontal" when used in connection with a faceguard 90 also includes bars of a faceguard 90 which are only substantially horizontal. Many faceguards 90, like the one shown in FIGS. 2B, 2C and 2D, have at least one top bar 92 which is not 100% horizontal but instead is curved slightly downward or is curved slightly upward. Although such top bars 92 are not perfectly horizontal, they can be used in connection with the retainer 10 of the present invention. Accordingly, such upper bars 92 are considered to be "horizontal" for purposes of the present invention.

The retainer of the invention 10 includes a base portion 12 having a front surface 30 and a back surface 32, the back surface 32 of the base 12 is configured to be fixedly attached to the outer surface of the headgear 80 at a center of the headgear above the face opening 82. The back surface 32 of the base 12 also has a selected curvature to match the selected curvature of the outer surface of the headgear 80 above the face opening 82. For example, the selected curvature can be 38 degrees.

The size of the base portion should be determined based on the durability and tensile strength requirements of the particular headgear 80 it is used with. For example, a base portion 12 having a top edge, a bottom edge, a right edge and a left edge can have a length of 3.280 inches, i.e, from right edge to left edge, and can have a height of 1.487 inches, i.e., from top edge to bottom edge. Similarly, the thickness of the base portion 12 should be determined on a case by case basis. For example, a base having a thickness of 0.150 inches can be used.

The inventive retainer 10 can be fixed to the helmet 80 by various fastening means. For example two holes 24 which accept various fastening means can be provided and appropriately spaced on the base portion 12. An example of appropriately spaced holes, would be two holes 24 measuring 0.215 inches in diameter positioned on a right and left side of the base portion 12 above the retention arms 16*a*, 16*b*. Each of the holes having a center point which may be a distance of 0.038 inches from the top edge of the base portion 12.

As shown in FIGS. 2A through 2D, the specific fastening means can be one or more appropriately spaced rivets 40. Additionally, adhesive can be applied to the back surface 32 of the base portion 12 and the retainer 10 glued to the headgear 80. The present invention 10 and the headgear 80 can also be formed of one continuous piece of material as would be the case if the helmet 80 and retainer 10 were formed together in a mold.

Two complementary retention arms 16*a*, 16*b* are provided for securing the at least one top bar 92 of the faceguard 90. As illustrated in FIGS. 1A through 1D, the retention arms 16*a*, 16*b* protrude out from the front surface 30 of the base 12 to form two complementary retention channels 18*a*, 18*b* respectively having downward and upward openings for receiving the at least one substantially horizontal bar 92 of the faceguard 90. Thus, a minimum requirement of the faceguard 90 to be used with the inventive retainer 10 is that its top bar 92 be long enough to extend into both retention channels 18*a*, 18*b* of the retainer 10.

Furthermore, both retention channels 18*a*, 18*b* have an inner surface which together surround at least a portion of the outer perimeter of the top horizontal bar 92 of the faceguard 90. Moreover, each of the two retention arms 16*a*, 16*b* have a base end 22*a*, 22*b* which is attached to the base portion 12 as well as a free end 20*a*, 20*b* opposite the base end 22*a*, 22*b*. The free ends partially define the upward and downward openings of the retention channels 18*a*, 18*b*. The size of the upward and downward openings should be determined based on the thickness of the top bars 92 of the faceguard 90 that the inventive retainer 10 is being used with. For example, the downward and upward spaces can be 0.245 inches.

Additionally, the complementary retention channels 18*a*, 18*b* can be shaped to accommodate a faceguard 90 with various shaped bars. For example the channels can be shaped to accept bars that have a square or rectangular cross section. A further example as shown in FIGS. 1A to 1D, the channels 18*a*, 18*b* can be shaped to receive a faceguard having bars with a circular cross section.

Figure 1B:
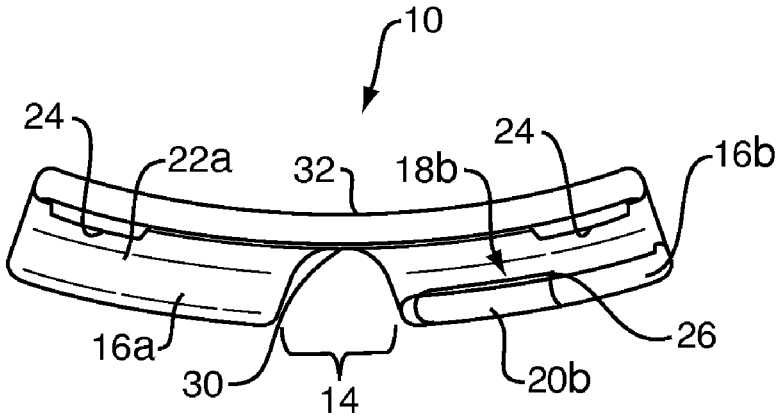
FIG. 1B is a top view of the quick release faceguard retainer according to the embodiment of FIG. 1A.
Figure 1C:
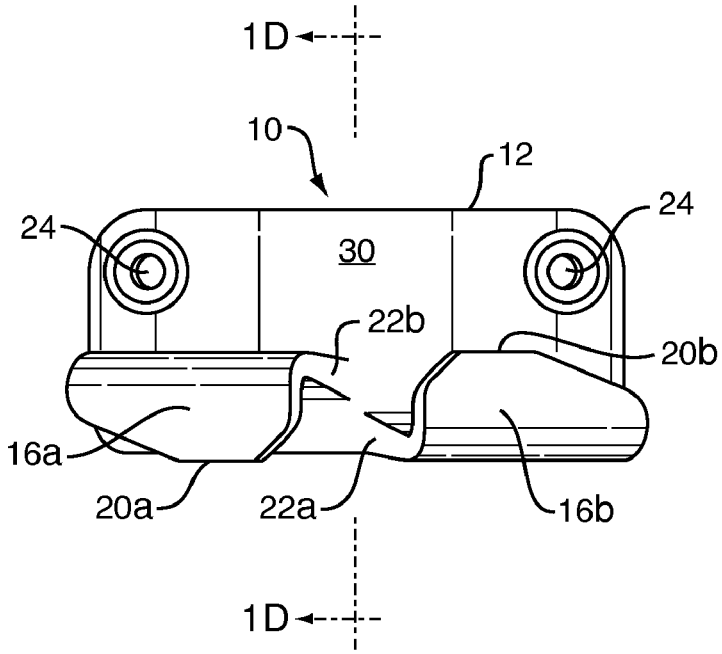
FIG. 1C is a front view of the quick release faceguard retainer of FIG. 1A.
Figure 1D:
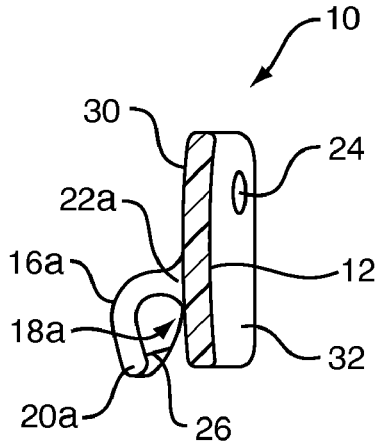
FIG. 1D is a cross sectional view of the quick release faceguard retainer according to FIG. 1A taken along arrow 1D-1D in FIG. 1C.

Additionally as shown in FIGS. 1B and 1D, each of the retention arms 16*a*, 16*b* may be provided with a retention lip 26 for further securing the at least one top substantially horizontal bar 92 of a faceguard 90. The retention lips 26 are positioned at the free ends 20*a*, 20*b* of retention arms 16*a*, 16*b* and on the inner surface of the two complementary retention channels 18*a*, 18*b*.

Provided between the two complementary retention arms 16*a*, 16*b* is a faceguard engagement space 14 sized to fit the at least one top horizontal bar 92. Thus, the size of the engagement space 14 should be determined based on the particular faceguard it is being used with. However, in any case the engagement space 14 must be at least slightly larger than the cross section of the top bar 92 of the faceguard it is being used with.

The present invention 10 can be made from any material having sufficient strength and durability to withstand ordinary stresses typically exerted on a faceguard during use in contact sports and/or dangerous or potentially dangerous activities. For example, the inventive quick release faceguard retainer 10 can be made entirely of polycarbonate plastic.

FIG. 2A-2D show how a faceguard 90 engages and disengages the retainer 10. First the faceguard 90 must be twisted roughly 90 degrees so that its top horizontal bar 92 is vertical as shown in FIG. 2B. The embodiment of the present invention shown in FIGS. 2A-2D is configured so that in order to properly engage the helmet 80 the faceguard 90, starting from its upright position shown in FIG. 2D, must be initially twisted counterclockwise and then twisted back in a clockwise direction.

However, the position of the complementary retention arms 16*a*, 16*b* and hence the retention channels 18*a*, 18*b* can be reversed. In such an embodiment the faceguard 90, starting form an upright position would have to be first twisted in a clockwise direction and then back in a counterclockwise direction.

Referring again to FIG. 2B, the top horizontal bar 92, now vertical, is then moved into the initial faceguard engagement space 14. Once the top horizontal bar 92 is in the engagement space 14 between the two retention arms 16*a*, 16*b*, then the faceguard 90 is twisted 90 degrees in the opposite direction, i.e., clockwise, until the perimeter of the top horizontal bar 92 is received by, i.e., becomes at least partially surrounded by, the inner surface of the retention channels 18*a*, 18*b*. At this point, the top of the faceguard 90 is secured to the headgear 80 and can pivot as illustrated in FIG. 2C. Finally, the faceguard 90 is moved to its upright position as shown in FIG. 2D and its lower portion 94 is secured to the headgear 80 using any of the conventional or appropriate means 94 for attachment 94.

While specific embodiments of the invention have been shown and described in detail to illustrate the application of the principles of the invention, it will be understood that the invention may be embodied otherwise without departing from such principles.

What is claimed is:

1. A quick release faceguard retainer (10) for use in with a protective headgear (80) and a faceguard (90), the protective headgear (80) having a face opening (82) and an outer surface with a selected curvature above the face opening (82), the faceguard comprising at least one top substantially horizontal bar (92) and at least one lower portion (94), the quick release faceguard retainer (10) comprising:

a base portion (12) having a front surface (30) and a back surface (32), the back surface (32) of the base (12) being adapted to be fixedly attached to the outer surface of the headgear (80) at a center above the face opening (82), the back surface (32) of the base (12) having a selected curvature matching the selected curvature of the outer surface of the headgear (80) above the face opening (82);

two complementary retention arms (16*a*, 16*b*) for securing the at least one top bar (92) of the faceguard (90), the retention arms (16*a*, 16*b*) protruding out from the front surface (30) of the base (12) to form two complementary retention channels (18*a*, 18*b*) each having an inner surface which together surround at least part of an outer perimeter of the top horizontal bar (92) of the faceguard (90), the two retention arms (16*a*, 16*b*) each comprising a base end (22*a*, 22*b*) attached to the base portion (12) and an opposite free end (20*a*, 20*b*), one of the channels (18*a*, 18*b*) being upwardly open and the other channel (18*a*, 18*b*) being downwardly open for receiving a portion of the at least one top bar (92) into each channel (18*a*, 18*b*); and a faceguard engagement space (14) between the two retention arms (16*a*, 16*b*) having a size for receiving the top bar (92).

2. A quick release faceguard retainer (10) as claimed in claim 1, wherein the quick release faceguard retainer (10) is made entirely of one piece of plastic.

3. A quick release faceguard retainer (10) as claimed in claim 1, wherein both retention arms (16*a*, 16*b*) comprise a retention lip (26) positioned at the free ends (20*a*, 20*b*) of the retention arms (16*a*, 16*b*) and on the inner surface of the two complementary retention channels (18*a*, 18*b*).

4. A quick release faceguard retainer (10) as claimed in claim 1, wherein the base portion (12) comprises at least two holes (24) to accommodate a means for fastening the quick release faceguard retainer (10) to the outer surface of the headgear (80).

5. A quick release faceguard retainer (10) as claimed in claim 4, wherein the fastening means comprise two rivets (40) positioned on either side of the base portion (12) above the two retention arms (16*a*, 16*b*).

6. A quick release faceguard retainer (10) as claimed in claim 1, wherein the inner surface of the complementary retention channels (18*a*, 18*b*) have an inner shape to fit a top bar (92) having a circular cross section.

7. A quick release faceguard retainer (10) as claimed in claim 1, wherein the inner surface of the complementary retention channels (18*a*, 18*b*) have an inner shape to fit a top bar (92) having a square cross section.

8. A quick release faceguard retainer (10) as claimed in claim 1, wherein the inner surface of the complementary retention channels (18*a*, 18*b*) have an inner shape to fit a top bar (92) having a triangular cross section.

9. A quick release faceguard retainer (10) as claimed in claim 1, wherein the back surface of the base portion (12) is fixedly attached to the headgear (80) by adhesive.

* * * * *